US006003910A

United States Patent [19]

Dupont et al.

[11] Patent Number: 6,003,910

[45] Date of Patent: Dec. 21, 1999

[54] ELECTRIC LOCK FOR VEHICLE DOOR

[75] Inventors: Patrick Dupont, Noyelles sur Mer; Jean-Marie Lefebvre, Epagnette; Jean-Philippe Hochart, Buigny-L'Abbe, all of France

[73] Assignee: Valeo Securite Habitacle, Creteil, France

[21] Appl. No.: 09/148,066

[22] Filed: Sep. 4, 1998

[30] Foreign Application Priority Data

Sep. 19, 1997 [FR] France ..... 97 11680

[51] Int. Cl.[6] ..... E05C 3/06

[52] U.S. Cl. ..... 292/201; 292/216; 292/DIG. 23; 292/DIG. 27

[58] Field of Search ..... 292/201, 144, 292/216, 169.11, DIG. 23, DIG. 27, DIG. 65, DIG. 62

[56] References Cited

U.S. PATENT DOCUMENTS

| | | | |
|---|---|---|---|
| 4,929,007 | 5/1990 | Bartczak et al. | 292/336.3 |
| 5,007,261 | 4/1991 | Quantz | 70/240 |
| 5,238,274 | 8/1993 | Becker et al. | 292/201 |
| 5,564,761 | 10/1996 | Mizuki et al. | 292/201 |
| 5,802,894 | 9/1998 | Jahrsetz et al. | 70/264 |
| 5,881,584 | 3/1999 | Brunoski et al. | 70/68 |

FOREIGN PATENT DOCUMENTS

| | | | |
|---|---|---|---|
| 0 133 508 A1 | 2/1985 | European Pat. Off. | E05B 65/32 |
| 0 217 169 A1 | 4/1987 | European Pat. Off. | E05B 65/20 |
| 0 775 791 A1 | 5/1997 | European Pat. Off. | E05B 47/00 |
| 33 33 746 A1 | 6/1985 | Germany | E05B 65/20 |
| 85 13 658 | 8/1985 | Germany | E05B 65/32 |
| 34 14 475 C1 | 12/1985 | Germany | E05B 65/20 |

*Primary Examiner*—Darnell M. Boucher
*Assistant Examiner*—Clifford B Vaterlaus
*Attorney, Agent, or Firm*—Pollock, Vande, Sande & Amernick

[57] ABSTRACT

Lock comprising a rotary latch and a pawl for retaining the latch; external opening control rod and internal opening control rod for acting on the pawl by way of an intermediate lever and an electric drive. The intermediate lever has one end connected to the pawl. The lever being articulated in such a way as to be able to pivot at least about two different axes forming an angle between them. A pivoting of the lever about a first direction permits the locking function to be performed, a pivoting of the lever about the second direction permits the child safety function to be performed, and a combined pivoting of the lever about the first and second directions permits the double-locking function to be performed, so that the electric drive has only to control two movements in order to execute the three functions: locking, child safety and double-locking.

20 Claims, 6 Drawing Sheets

ELECTRIC LOCK FOR VEHICLE DOOR

BACKGROUND OF THE INVENTION

The invention relates to an electric lock for a vehicle door, of the type comprising:

a rotary latch, able to engage with a striker, and a pawl for retaining the latch in the closed position;

external opening control means and internal opening control means for acting on the pawl, by way of connection means, and releasing the latch for opening;

and electric drive means for inhibiting: either the external opening control means alone (locking function); or the internal opening control means alone (child safety function); or both the external opening control means and the internal opening control means (double-locking function).

In brief, the locking function makes it possible to prevent opening of the lock from outside the vehicle; the child safety function makes it possible to prevent opening of the lock from inside the vehicle, while the double-locking function makes it possible to prevent opening of the lock both from outside and from inside the vehicle, so that even by smashing the window of the door, it is not possible to open this door.

The electric locks known to date use a different electric motor for each function mentioned above; three electric motors are therefore needed to perform the three functions.

SUMMARY OF THE INVENTION

The main object of the invention is to provide an electric lock which requires limited and thus less costly electrical drive means for enabling the three functions.

The invention is also aimed at simplifying the connection means and at reducing the number of components therein so as to improve the impregnability and reliability of the lock, without thereby increasing its cost, and indeed even reducing it.

According to the invention, an electric lock for a vehicle door, of the type defined above, is characterized in that the connection comprises an intermediate lever for transmission, of which one end is connected to the pawl. The lever is being articulated in such a way as to be able to pivot at least about two different geometric directions forming an angle between them, the arrangement being such that a pivoting of the lever about a first direction permits the locking function to be performed, a pivoting of the lever about the second direction permits the child safety function to be performed, and a combined pivoting of the lever about the first and second directions permits the double-locking function to be performed. Therefore the electric drive means have only to control two movements in order to execute the three functions—locking, child safety, and double-locking.

The lever is preferably articulated by means of a ball-and-socket joint.

Generally, the two geometric directions about which the lever can pivot are orthogonal.

The lever can be pivoted on an intermediate piece which is itself connected to the pawl.

Advantageously, an electric motor, with reversible reducer, controls each of the two pivoting movements of the lever about the two different geometric directions.

According to one embodiment, the end of the lever remote from the articulation forms a blade situated in line with the ends of two connecting rods which each pivot about a respective fixed pin carried by a lock casing, and are substantially parallel to the geometric directions about which the lever can pivot. The arrangement is such that a pivoting of the lever about the first direction allows the blade to escape from the first connecting rod while remaining in cooperation with the second connecting rod, while the pivoting of the lever about the second direction allows the blade to escape from the second connecting rod while remaining in cooperation with the first connecting rod, and the combined pivoting of the lever about both directions allows the blade to escape from both connecting rods.

Advantageously, the lever is pivoted about the first direction with the aid of a piece mounted pivotably on a fixed pin carried by the lock casing and parallel to the first direction. The piece includes a toothed sector which is able to mesh with a helical pinion driven by an electric motor, and a fork in which there is engaged a stud integral with the lever. The stud is able to leave the seat of the fork by a displacement which is substantially perpendicular to the mid plane of the fork, corresponding to the pivoting of the lever about the second direction. The end zone of this piece opposite the toothed sector is connected to a pull bar.

The control of the child safety function may comprise an arm whose overall direction is substantially orthogonal to the direction of the lever. The arm is carried by a helical pinion which is able to turn, in a reversible manner, about a geometric axis parallel to the second direction of pivoting of the lever. Also, the arm is equipped, at its end remote from the pinion, with a fork which engages round a zone of the lever, the rotational movement of the arm causing a pivoting movement of the lever about the second direction.

The helical pinion is equipped at the end with an accessible mechanical socket to permit manual operation of the pinion if the motor breaks down.

Advantageously, the lock is equipped with electric members of assistance for opening and closing the door, in particular for compressing the door sealing strip. In a general manner, the latch of the lock includes two notches, and the purpose of the closure assistance is to cause movement to the second notch by the drive when the door has been brought manually to the first notch of the latch.

The members for assisting in the closure and opening of the door comprise:

electric drive means able to rotate a plate;

and a link rod pivoted at one of its ends on the plate and equipped, at its other end, with an actuator actuating means able to bring the latch into the complete closed position in response to the rotation of the plate.

The actuator of the link rod can comprise a stud cooperating with a guide and is able to act against a nose provided on the latch in order to push the latch into the complete closed position in response to the rotation of the plate.

The lock advantageously includes a sensor sensitive to the position of the latch in order to trigger the electric drive member of assistance when the latch arrives in the position where the first notch cooperates with the pawl, the member of assistance ensuring the passage of the latch from this intermediate closed position to the complete closed position in which the second notch cooperates with the pawl.

The guide of the stud, situated at the end of the link rod remote from the plate, can consist of a slot forming a cam provided on a main face of a backplate serving as a support for the latch and the pawl.

The lock can include a piece which rotates about the same geometric axis as the pawl, this piece being linked in rotation to the pawl, with a possibility of free angular movement between the piece and the pawl over a limited angular range. The connection between this piece and the pawl can comprise, on one of these two elements, in particular on the piece, a window of a certain angular extent and, on the other element, in particular the pawl, a projecting stud engaged in the window with free movement between edges, of substantially radial orientation, of the window.

The piece can include a projecting finger directed substantially towards the center of the plate. The finger being able to cooperate, depending on the angular position, with a projecting cam at the center of the plate or with a stud provided near the periphery of the plate, the action of the cam or stud against the finger making it possible to turn the piece in a direction which distances the pawl from the latch in order to permit opening.

Advantageously, the piece is pivoted, in particular by a ball-and-socket joint provided on a projecting lug of this piece, on the intermediate lever of the connection between, on the one hand, the pawl and, on the other hand, the external opening control means and the internal opening control means.

Preferably, the stop position of the plate corresponding to the complete closed position, with cooperation of the second notch of the latch with the pawl, is controlled in particular by a sensor in such a way that the stud situated at the end of the link rod remote from the plate occupies a position which prevents any interference with the latch, in particular with the nose of the latch, for a return to the open position.

Advantageously, the lock comprises members which make it possible to uncouple the plate from its drive pin so that the plate becomes loose in rotation and does not constitute an obstacle to manual opening or closing in the event of the electric assistance means breaking down.

Besides the arrangements explained hereinabove, the invention consists of a number of other arrangements which will be discussed in greater detail hereinbelow on the basis of illustrative embodiments which are described with reference to the attached drawings, but which are in no way limiting.

DETAILED DESCRIPTION OF THE INVENTION

Figure 1:
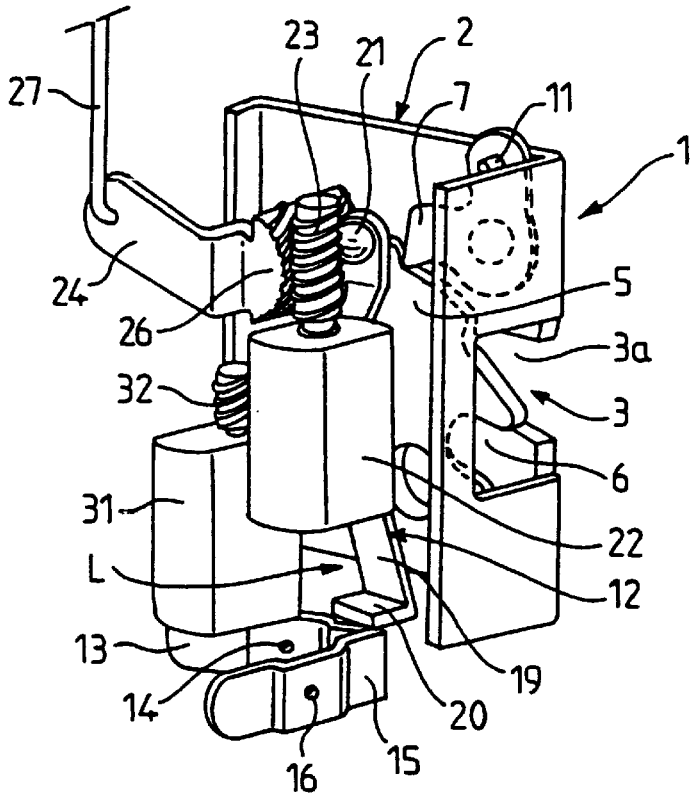
FIG. 1 is a diagrammatic perspective view of an electric lock for vehicle door according to the invention.
Figure 2:
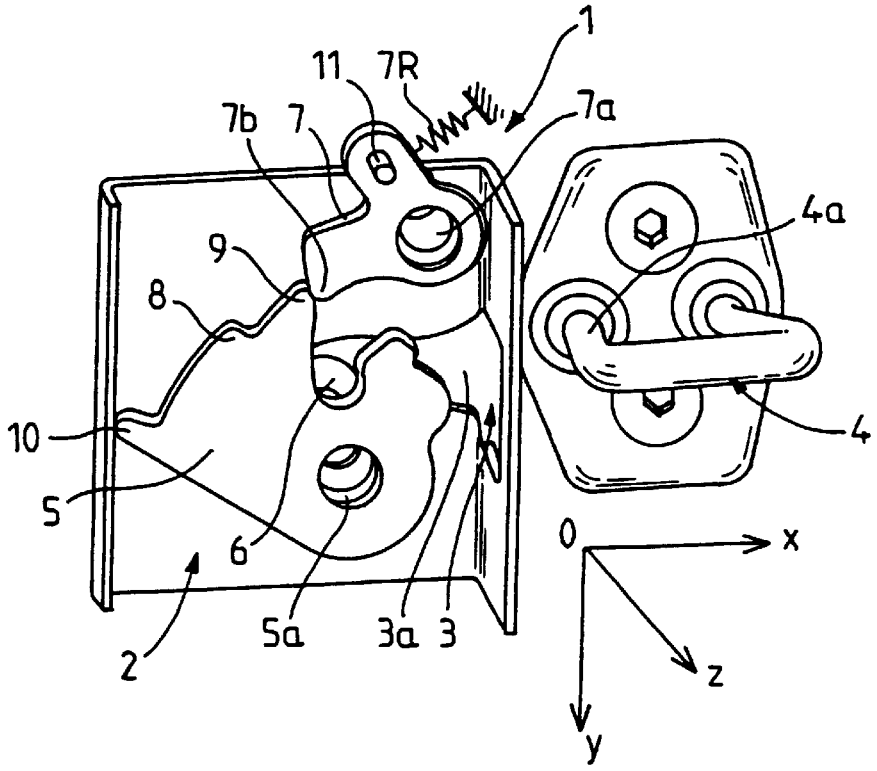
FIG. 2 is a perspective view of the lock in FIG. 1, from another angle, in which the electric drive means, the intermediate lever and the connecting rods have been omitted, while a striker intended to be fixed on an upright of the door frame is represented.

Referring to the drawings, in particular to FIGS. 1 and 2, an electric lock 1 can be seen which is intended to be fixed on a vehicle door (not shown) via a backplate 2 in the form of an angled bracket in which there is a recess 3. This recess 3 has a horizontal V shape 3*a* on the main face of the backplate 2. The recess 3, or "gully", permits the passage of the striker 4 which is fixed on an upright surface of the door frame.

The lock 1 includes a rotary latch 5 with a fork 6 in which a branch of the striker 4 is able to engage. In the representation in FIG. 2, the latch 5 is shown in the closed position with the seat of the fork 6 directed upwards. This position is normally reached with the branch 4*a* of the striker 4 engaged in the fork 6. Opening can only be obtained by freeing the latch 5 to rotate in the clockwise direction in order to bring it back to the open position, with the seat of the fork 6 substantially horizontal, its aperture being situated towards the right according to the representation in FIG. 2. It is then possible to separate the latch 5 from the striker 4.

The lock 1 is fixed on the door by screws (not shown) which pass through the pins (not shown) of the latch 5 and of a pawl 7 for retaining the latch, these pins passing through circular holes 5*a*, 7*a*.

According to the arrangement in FIGS. 1 and 2, the pawl 7 is situated above the latch. The latch includes a sector equipped with two notches 8, 9 which are able to abut against a nose 7*b* of the pawl 7 which is stressed by a spring 7R, shown diagrammatically, in such a way as to turn in the anticlockwise direction around its axis of pivoting. The latch 5 comprises a nose 10 projecting radially at the end of the sector remote from the notch 9.

A tri-rectangular trihedron Ox, y, z has been shown diagrammatically in FIG. 2. The direction Ox, parallel to the main face of the backplate 2, is the transverse direction of the vehicle and corresponds substantially to the direction of closure or opening of the door. The direction Oz is the longitudinal direction of the vehicle, while the direction Oy is the vertical direction. The part 3*a* is oriented in the transverse direction.

When the striker 4 enters the fork 6 of the latch which is turned horizontally, the latch 5 pivots in the anticlockwise direction, according to the representation in FIG. 2, and comes into the closed position in which the pawl 7 retains it via one of the notches 8 or 9.

The door is opened by freeing the latch 5 by means of acting on the pawl 7 in order to turn it in the clockwise direction. The pivoting of the pawl is obtained by pushing upwards on a stud 11 integral with this pawl by way of connection means L (see FIG. 12) comprising a piece P, connected to the pawl, which will be discussed hereinafter.

These connection means L comprise an intermediate transmission lever 12 (FIG. 1).

The lock can be opened from the outside by external opening control means which are represented only by a connecting rod 13 which is pivoted about a pin 14 fixed on the casing (not shown) of the lock with the aid of the other components of these external opening control means.

Internal opening can be obtained with the aid of internal opening control means which are represented only by a connecting rod 15, arranged at right angles, in the example shown, in relation to the connecting rod 13, and able to pivot about a axis 16 which is fixed in relation to the lock casing.

Figure 7:
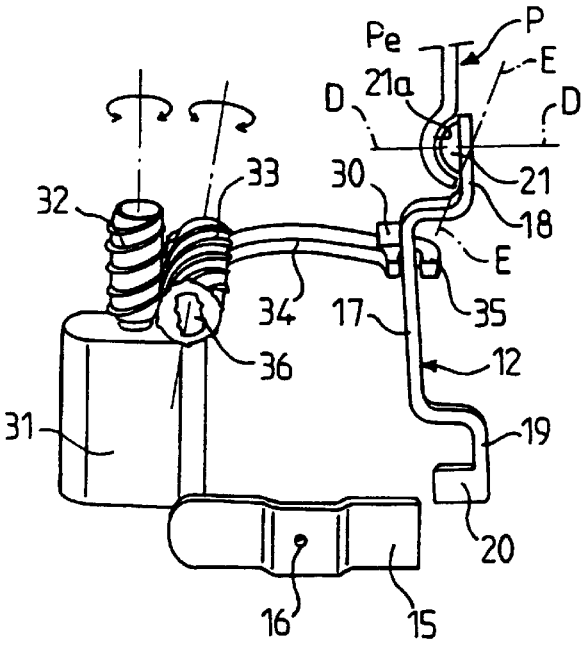
FIG. 7 is a partial diagrammatic perspective view of an electric motor with its reducer for controlling the pivoting of the lever in order to obtain the child safety function, the corresponding connecting rod also being represented.
Figure 8:
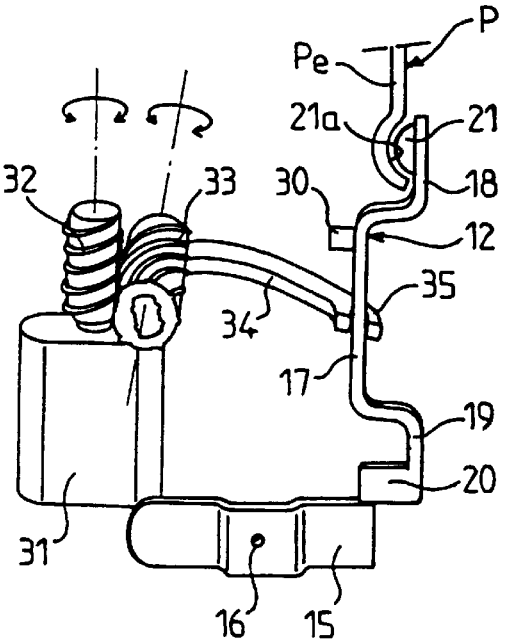
FIG. 8 shows the same elements as FIG. 7, but in a different relative position.

As can be seen in FIGS. 7 and 8, the intermediate lever 12 is oriented vertically as a whole; it consists of a bar which is bent at right angles a number of times and of which the central part 17 is off-centred relative to the top end 18 and bottom end 19.

The top end 18 of the lever is connected to the pawl 7 by way of the piece P.

The bottom end 19 ends in a blade 20 which is bent at a right angle, substantially horizontally, and is of rectangular shape.

Figure 3:
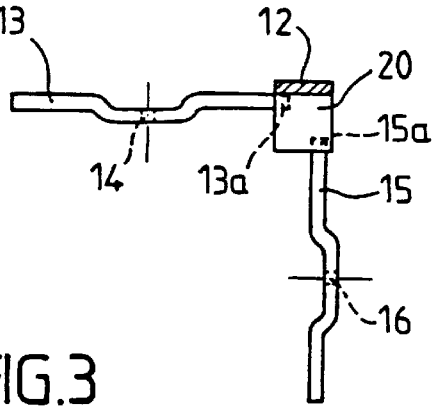
FIGS. 3 to 6 are diagrams, in plan views, illustrating the different possible positions of a blade, provided at the lever end, in relation to the connecting control rods.

In the unlocked position, in which the door can be opened both from the inside and from the outside, the blade 20 covers the ends 13*a*, 15*a* of the connecting rods 13 and 15, as is illustrated in FIG. 3. The connecting rods 13 and 15, whose mid planes are vertical in the embodiment shown, can then lift the lever 12 by rotating in the appropriate direction about their respective horizontal pin 14 or 16.

Figure 9:
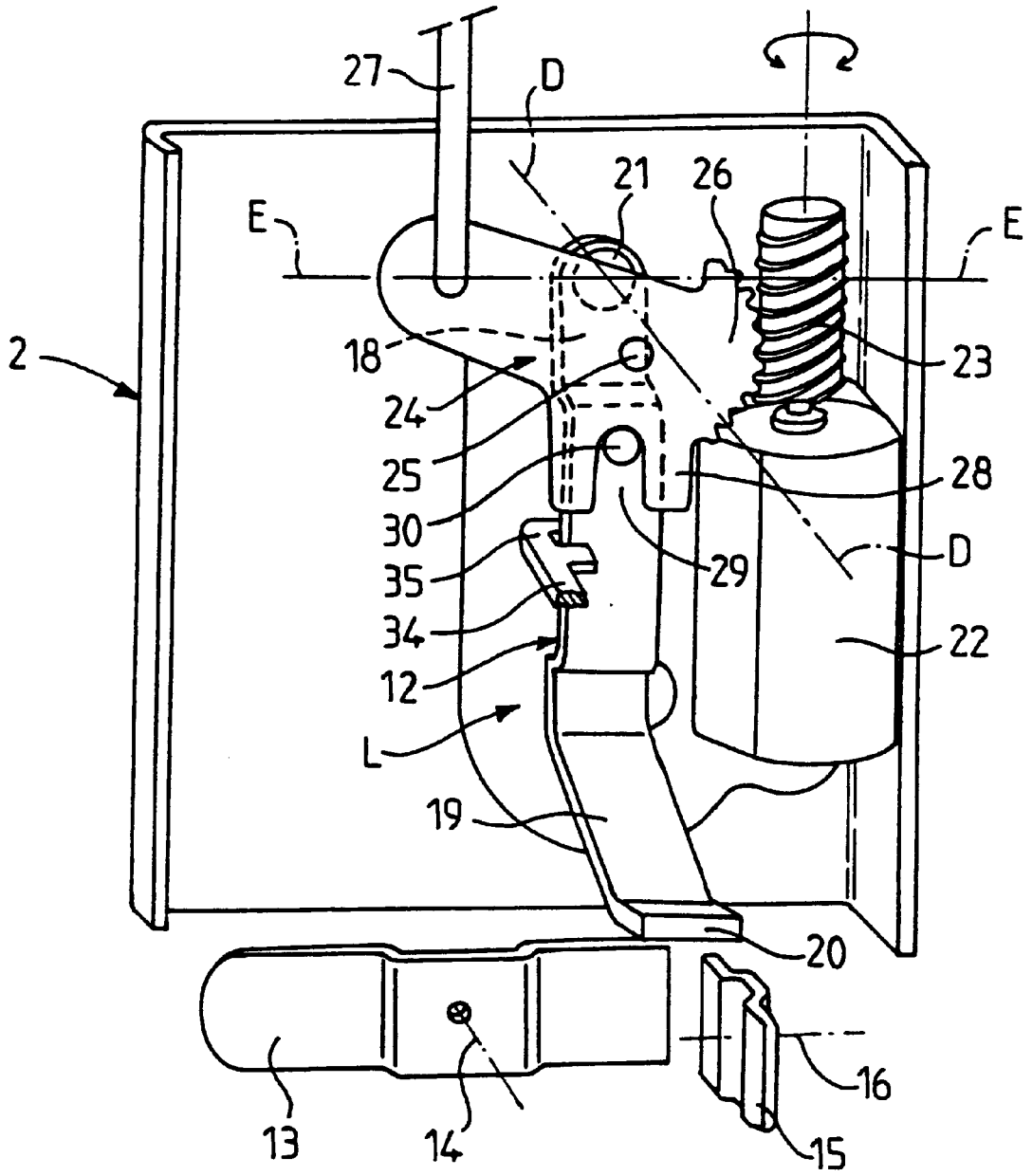
FIG. 9 shows a perspective view of the electric motor and the mechanism for controlling the pivoting of the lever about the first direction, while only the end of the arm carrying the fork of the child safety control mechanism is represented.

The lever 12 is articulated in such a way as to be able to pivot about at least two different geometric directions D—D, E—E (FIG. 9) forming an angle between them, respectively a first direction D—D orthogonal to the main face of the backplate 2, and a second horizontal direction E—E parallel to the main face of the backplate 2. In the example in question, these two directions are orthogonal.

The articulation is in the form of a ball-and-socket joint consisting of a convex spherical cap 21 which projects from the top end 18 of the lever 12 and is arranged in a matching concave seat 21*a* (FIGS. 7 and 8) provided in a lug Pe of the piece P.

The geometric axes of pivoting 14 and 16 of the connecting rods 13 and 15 are parallel to the directions D—D and E—E, respectively. The basic direction of the connecting rod 13 is parallel to the direction E—E, while the basic direction of the connecting rod 15 is parallel to the direction D—D.

A pivoting of the lever 12 about the direction D—D, in the appropriate sense, displaces the blade 20 in the direction of the arrow F1 (FIG. 4) parallel to the basic direction of the connecting rod 13. The amplitude of the displacement effected by the lever 12 is such that the blade 20 escapes from the connecting rod 13 and is no longer situated over this connecting rod, as can be seen in FIG. 4, while at the same time it remains over the end 15*a* of the connecting rod 15.

Figure 4:
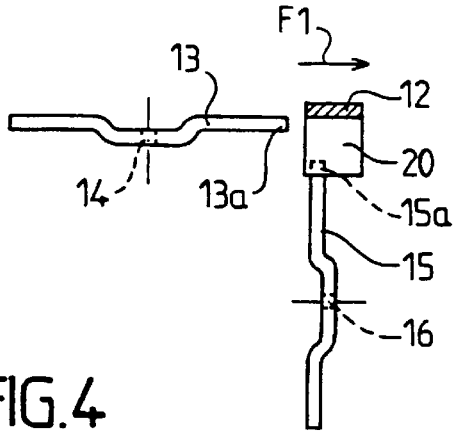

In the arrangement represented in FIG. 4, the external opening control means, in particular the connecting rod 13, are inhibited and can no longer act on the lever 20. By contrast, the internal opening control means (connecting rod 15) remain active and can act on the lever 20. The locking function is thus realized.

Figure 5:
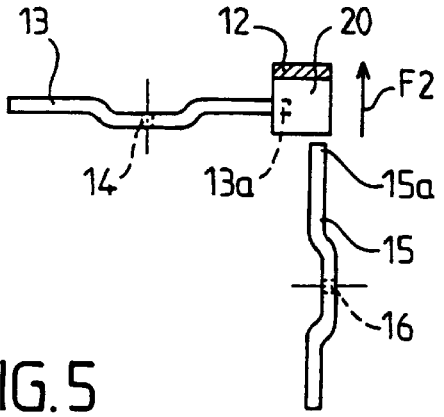

A pivoting of the lever 12 about the geometric axis E—E, with appropriate amplitude and in the appropriate sense, makes it possible to displace the blade 20 in a direction substantially perpendicular to the main face of the backplate 2, that is to say in the direction of arrow F2 in FIG. 5. The blade 20 can therefore escape from the end 15*a* of the connecting rod 15, while remaining over the end 13*a* (FIG. 5). The "child safety" function is ensured since the door cannot be opened from inside the vehicle, but the external control remains active.

The pivoting of the lever 12, illustrated in FIG. 5, corresponds to the bottom part of the lever 12 approaching the main face of the backplate 2.

Pivoting of the lever 12 about the direction D—D is effected by a first electric motor 22, with a vertical axis in the representation in the drawings, with its output shaft driving a reversible helical pinion 23. A piece 24, of which the mid plane is parallel to the main face of the backplate 2, is mounted so as to rotate about a fixed pin 25 carried by the lock casing, parallel to the direction D—D. The axis of rotation 25 is thus horizontal and orthogonal to the geometric axis of the pinion 23. The piece 24 includes a toothed sector 26 which meshes, in a reversible manner, with the pinion 23. On the side of the pin 25 opposite the pinion 26, the piece 24 is articulated on the end of a pull bar 27, partially represented, on which it is possible to exert manually an upward or downward vertical force, from inside the vehicle. Manual control is possible, when the motor 22 is not operating, by virtue of the reversibility of the connection between pinion 23 and toothed sector 26.

The piece 24 includes a fork 28 with two parallel branches delimiting a seat 29 which is open at the bottom. A stud 30 integral with the lever 12, and projecting parallel to the direction D—D, is engaged in the seat 29 when the lever 12 is in a position corresponding to the unlocking or simple locking of the lock or the child safety function.

It will be immediately apparent that when the stud 30 is engaged in the seat 29, the rotation of the pinion 23 by the motor 22, produces a pivoting of the lever 12 about the direction D—D and a displacement of the blade 20 in the direction of the arrow F1 (FIG. 4), or in the opposite sense, in the sense of rotation of the motor 22.

Pivoting of the lever 12 about the direction E—E, which is perpendicular to the plane of FIGS. 7 and 8, is effected by a second electric motor 31, which can be seen in FIGS. 1, 7 and 8, and which has a vertical axis in the embodiment in question. The output shaft, at the top of the motor 31, drives a reversible helical gearing 32 which meshes with a helical pinion 33 which has an axis orthogonal to that of the gearing 32. The pinion 33 is integral in terms of rotation with an arm 34 which extends substantially radially in the direction of the lever 12. This arm 34 includes, at its end remote from the pinion 33, a fork 35 whose branches engage on either side of the lever 12, about its edge.

The length 34 of the lever is chosen in such a way that in the angular position of the pinion 33 illustrated in FIG. 7, the arm 34 in the upper position pushes the lever 12 back, and the blade 20, displaced in the direction of arrow F2 (FIG. 5), escapes from the connecting rod 15.

With a sufficient rotation of the pinion 33 in the clockwise direction according to the representation in FIG. 8, the arm 34 lowers, and the fork 35 moves the lever 12, pivoting it clockwise about the direction E—E, in order to bring the blade 20 back in line with the end 15*a*. The stud 30 returns to the seat 29.

The pinion 33 includes, at least at one axial end, an engagement means 36, consisting for example of a hollowed-out zone, accessible from the outside of the door using a suitable tool, for manual actuation of the pinion 33 in the event of the motor 31 breaking down, in particular for manually cancelling the child safety function. This is possible by virtue of the reversible nature of the gearing/pinion connection 32/33.

The functioning of the lock in terms of the three functions—locking, child safety and double20 locking—will be clear from the above explanations and there will be no need to go back over this subject in detail.

Summarizing briefly, the motor 22, by means of its rotation, makes it possible to displace the blade 20 in the direction of arrow F1, as illustrated in FIG. 4, or in the opposite direction, and thereby to obtain the locking function and to cancel it by the reverse movement.

The electric motor 31 displaces the blade 20 in the direction of arrow F2 (FIG. 5) in order to obtain the child safety function, and displaces it in the opposite direction in order to cancel this child safety function.

Figure 6:
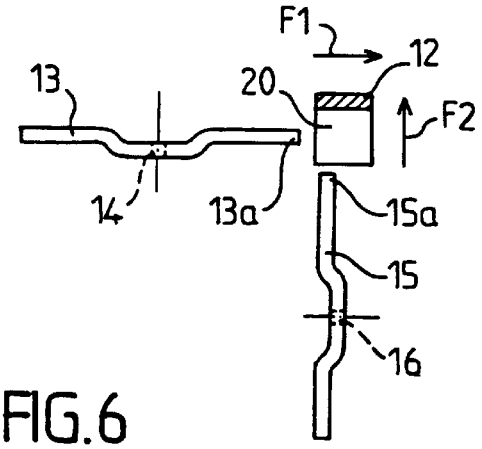

The combined pivoting of the arm 12 about both directions D—D and E—E, brought about by the rotation 35 of the motors 22 and 31, makes it possible to place the blade 20 in the position illustrated in FIG. 6, corresponding to double-locking. Operation of the motors 22 and 31 in the opposite direction makes it possible to cancel this double-locking.

It should be noted that to bring about double-locking, an automatic sequence is provided such that the motor 22 functions first, while the stud 30 is still engaged in the seat 29. The motor 31 then acts to pivot the arm 12 about the direction E—E, which causes the stud 30 to leave the seat 29. Although the stud 30 is no longer maintained between the branches of the fork 28, the lever 12 is prevented from returning, under the effect of its own weight, into the unlocked position by reverse rotation about the direction D—D, by virtue of the existence of sufficient friction or elastic means (not shown) for preventing such a return.

Because the stud 30 has left the seat 29, an action on the pull bar 27 can admittedly also move the piece 24 but is without any action on the lever 12 whose blade remains disengaged from the connecting rods 13 and 15. The double-locking function is thus highly effective and it is not possible to open the door from the outside or inside.

To suppress the double-locking function, the sequence of functioning of the motors 31 and 22 is reversed compared to when the double-locking function is being set up. The motor 31 is activated first in order to bring the arm 12 back to the position in FIG. 8, thereby engaging the stud 30 in the seat 29. The subsequent functioning of the motor 22 in the appropriate direction makes it possible, by turning the piece 24, to pivot the arm 12 about the direction D—D.

Figure 10:
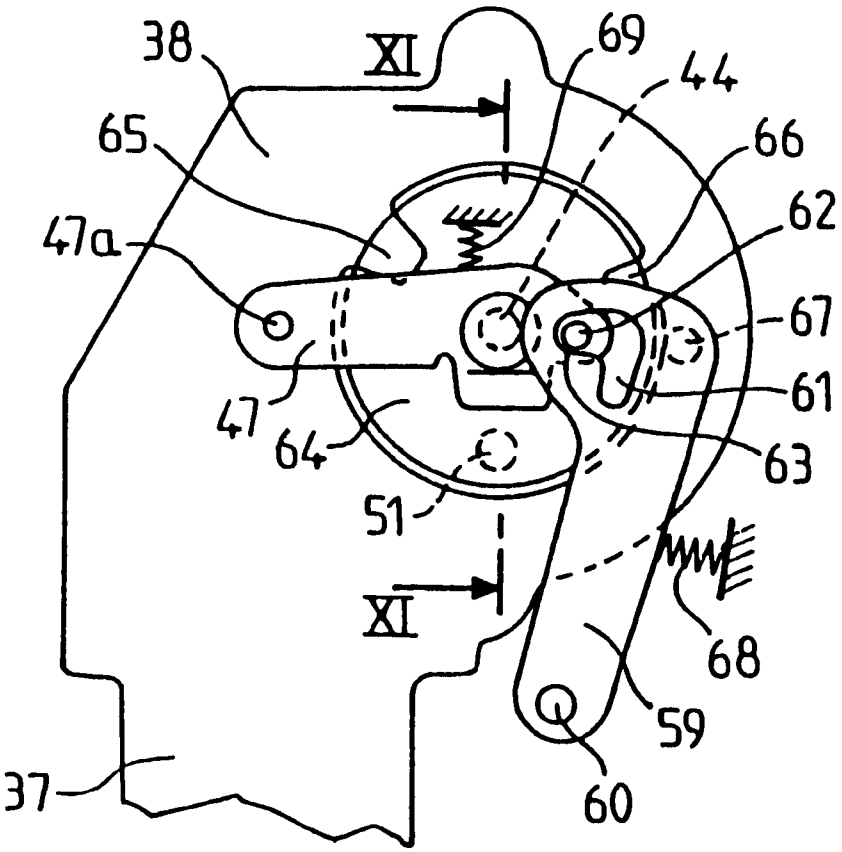
FIG. 10 is a diagrammatic view of an electric motor and its reducer for assisting in closing or opening the door, as seen from the right in relation to FIG. 11.

FIGS. 10 to 18 show means of assistance in opening and closing a door, these means comprising an electric motor 37 and a reducer 38 (FIG. 10).

Figure 15:
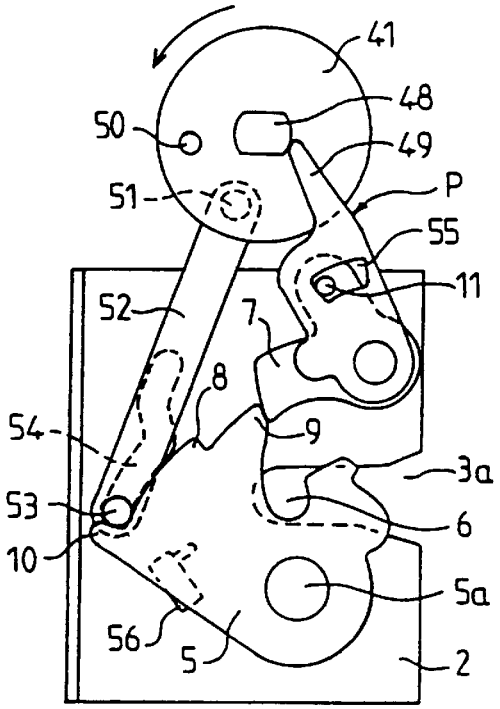
FIG. 15 illustrates the end of the closure assistance, the pawl having come into engagement with the second notch of the latch.

The aim of the assistance in closing a door is to automatically drive this door from an intermediate closed position, easy to bring about manually, in which the pawl 7 is in abutment against the first notch 8 of the latch (FIG. 13), to a position of complete closure, in which the pawl 7 is in abutment against the second notch 9 of the latch 5 (FIG. 15).

Figure 11:
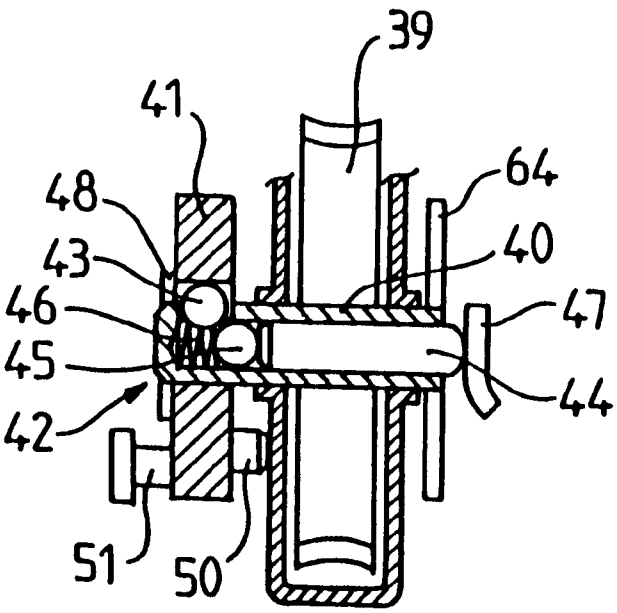
FIG. 11 is a partial sectional view along the line XI—XI in FIG. 10, with outside parts.

For this passage from one position to the other, it is necessary to have a sufficient torque to compress the sealing strips of the door. The motor 37 is thus equipped with the reducer 38 comprising a screw (not visible) and worm wheel 39 (FIG. 11).

The output of the reducer 38 consists of the end of a hollow shaft 40 (FIG. 11) which is integral in rotation with the wheel 39. A plate 41, the mid plane of which is orthogonal to the geometrical axis of the shaft 40, is mounted at the end of this shaft. The plate 41 is driven in rotation, from the shaft 40, via disengaging means 42 which make it possible, when so desired, to uncouple the plate 41 from the shaft 40 in terms of rotation.

These disengaging means 42 comprise a ball 43 traversing a hole provided in the shaft 40 and projecting radially into a groove of a bore in the plate 41. The ball 43 is held in this coupling position by the action of a cylindrical pusher 44 mounted slidably in the shaft 40. An end of this pusher 44, situated inside the sleeve 40, bears against another ball 45 which comes into contact with the ball 43 and pushes it towards the outside. This ball 45 is subjected to the force of a compression spring 46 arranged between a closed front end of the shaft 40 and the ball 45. The other end of the pusher 44 projects beyond the shaft 40 and bears against an arm 47 forming an abutment and able to be displaced in order to allow the pusher 44 to slide to the right in FIG. 11 under the action of the spring 46. This results in the ball 43 moving radially inwards and causing unwedging of the plate 41 relative to the shaft 40. Means for controlling the arm 47 will be described in greater detail hereinafter with reference to FIG. 10.

On its face remote from the wheel 39, the plate 41 includes a central projecting cam 48 whose contour consists of two parallel rectilinear segments connected at their ends by an arc of a circle centered on the axis of the plate 41.

The plate 41 is additionally equipped with a stud 50 projecting perpendicular to the mid plane of the plate and arranged in such a way as to act against an edge 49*a* of the finger 49 at the desired moment.

Figure 12:
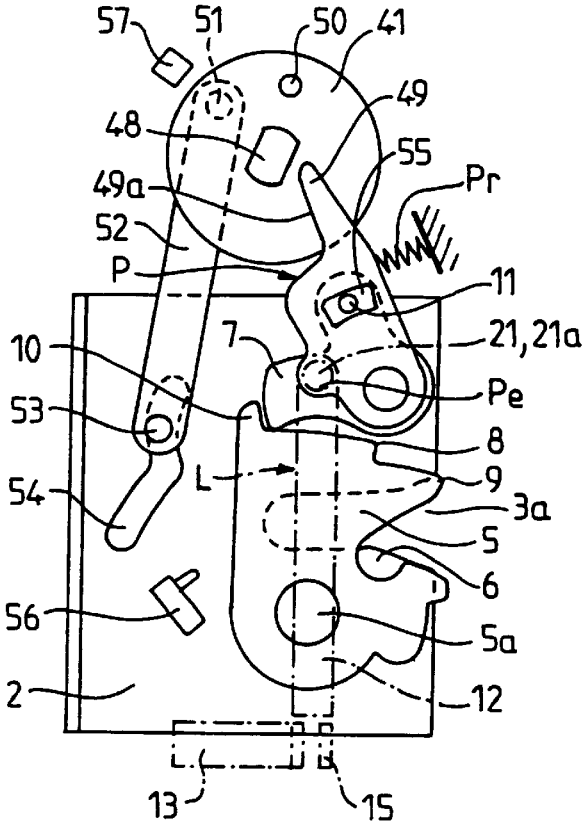
FIG. 12 is an elevation view of some of the pieces of the lock, with the latch in the open position, and the striker not represented.
Figure 14:
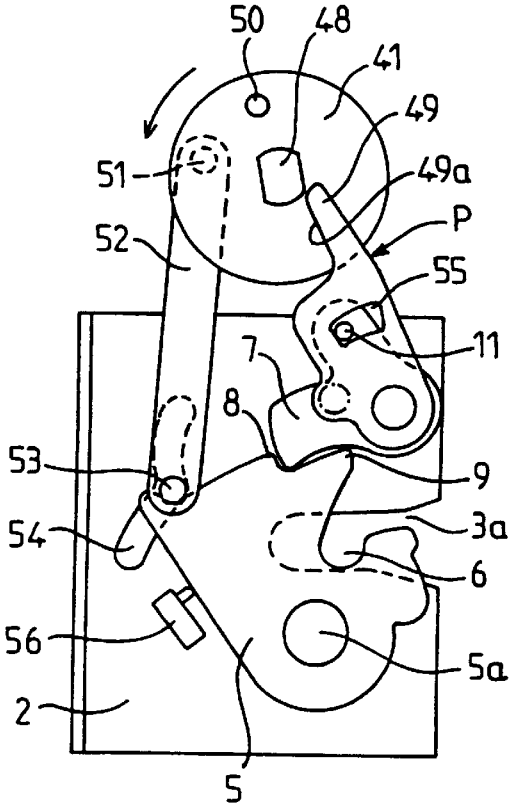
FIG. 14 shows, in a similar way to FIG. 13, the start of the closure assistance.

The other face of the plate 41 is equipped with a stud 51, preferably placed near the periphery and serving as a pivot pin for a connecting rod 52. The opposite end of this connecting rod 52 is equipped with a stud 53 projecting to either side of the mid plane of the connecting rod. The part of this stud 53 behind the connecting rod 52, according to the representation in FIG. 12, is engaged in an oblong slot 54 substantially in the shape of a flattened S, provided in the main face of the backplate 2. This slot 54 constitutes a cam whose shape is intended to provide the desired guiding of the stud 53. The part of this stud 53 projecting to the front of the connecting rod 52 can cooperate, under defined conditions, with the nose 10 of the latch 5, as is illustrated in FIG. 14.

The piece P consists of a plate which is mounted free in rotation about the same geometrical axis as the pawl 7. The rotational connection with the pawl 7 is provided by a window 55 of substantially trapezoidal shape, and of a certain angular extent, provided in the piece P. The stud 11 integral with the pawl 7 is engaged in this window 55. The piece P is stressed by elastic return means Pr in the anticlockwise direction according to the representation in FIGS. 12 to 14, like the pawl 7.

In the open position of the latch (FIG. 12), the stud 11 does not abut against the radial edge of the window 55.

A microcontact 56 is provided, fixed on the casing, for detecting the arrival of the latch 5 in the position corresponding to the first notch, and for controlling the start-up of the motor 37 in order to drive the plate 41 in the anticlockwise direction according to the representation in FIGS. 12 to 18.

The rest position of the device corresponds to the representation in FIG. 12, with the latch 5 in the open position. The stud 53 is situated in the upper half of the slot 54. The arrest in this position is controlled by a sensor 57, preferably a Hall effect sensor, of which a fixed element is placed, slightly set apart from the circumference of the plate 41, in an angular position corresponding substantially to the position occupied by the hour hand of a clock indicating eleven o'clock. The sensor 57 can detect the arrival of the stud 51, which may possibly be equipped with an element matching the sensor 57.

Figure 13:
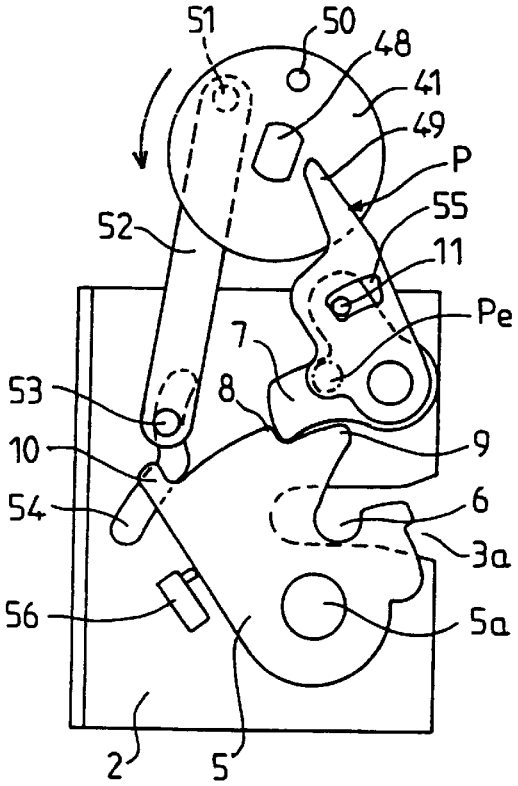
FIG. 13 shows, in a similar way to FIG. 12, the start of closure, the striker not represented.

It should be noted that the position of the stud 53, in the upper part of the slot 54, is such that the nose 10 of the latch 5 can turn in the anticlockwise direction, as illustrated in FIG. 13, without interfering with the stud 53.

Figure 16:
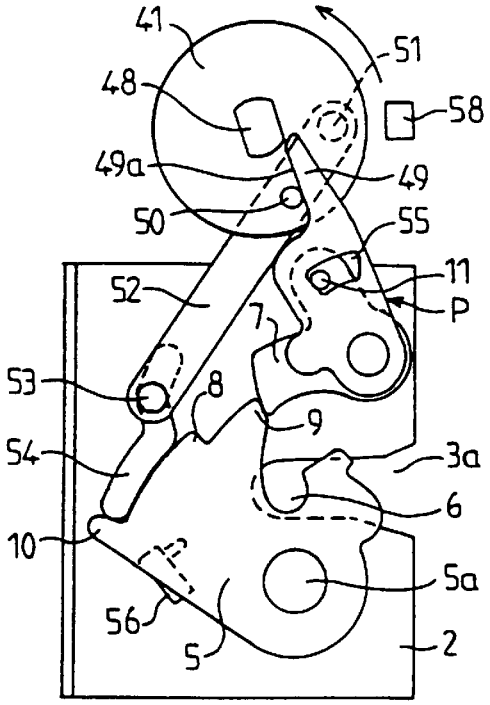
FIG. 16 illustrates the continuation of the rotation of the plate, taking the connecting rod with it.

The closed position corresponds to that represented in FIG. 16, the motor 37 and the plate 41 having been stopped. A sensor 58, preferably a Hall effect sensor, which is slightly set apart from the circumference of the plate 41, and whose angular position corresponds to that of the small hour hand on a clock indicating three o'clock, stops the motor on detecting the arrival of the stud 51.

This being the case, the functioning of the device for assisting in closing and opening the door is explained hereinafter with reference to FIGS. 12 to 18.

Let us consider the starting position in FIG. 12, corresponding to the rest position with the door open. The piece P is maintained in its rest position by the elastic return means Pr, the stud 11 being substantially at the center of the window 55, set apart from the two edges, of radial orientation, of this window.

When the user manually initiates the closure of the door, the striker (not shown) enters the gully 3*a* and the fork 6 of the latch 5, which turns in the anticlockwise direction, the nose 10 passing the stud 53 without any interference. The pawl 7 comes to bear against the first notch 8 of the latch, as is illustrated in FIG. 13. For this reason, the pawl 7 has turned slightly in the anticlockwise direction, and the stud 11 has come into the immediate vicinity of that radial edge of the window 55 which is leading in the anticlockwise direction.

The arrival of the latch 5 in the angular position in FIG. 13 is detected by the microcontact 56 which initiates the start-up of the motor 33 in such a way that the plate 41 turns in the anticlockwise direction in FIG. 13.

The rotation of the plate 41 causes the downward movement of the connecting rod 52 and that of the stud 53 in the slot 54, as is illustrated in FIG. 14. The stud 53 comes into abutment against the nose 10.

Continuing its rotation in the anticlockwise direction, the plate 41 pushes the latch 5 into the "second notch" closed position illustrated in FIG. 15, in which the second notch 9 has come into abutment against the nose of the pawl 7. This is the process of closure assistance.

The plate 41 continues its rotation in the anticlockwise direction until the stud 51 arrives in line with the sensor 58 (FIG. 16) which stops the motor 33 and thus the plate 41. The stud 53 is then situated in the upper half of the slot 54.

Figure 17:
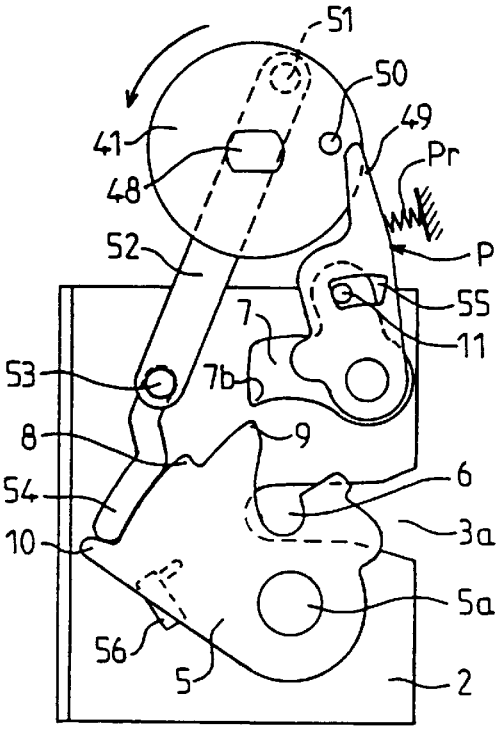
FIG. 17 illustrates the start of opening.

When the control means for opening the door is operated, the motor 33 and the plate 41 are set in rotation in the same anticlockwise direction in order to pass from the position in FIG. 16 to that in FIG. 17. The stud 50 acts against the edge 49*a* of the finger 49 and pushes back the piece P, which turns in the clockwise direction and moves the pawl 7 in the same direction, so as to free the notch 9 of the latch 5. The stud 53 is again situated in the vicinity of the upper end of the slot 54 and leaves a passage free for the nose 10 of the latch 5, which turns in the clockwise direction towards the open position, in particular on account of the release of pressure on the door sealing strips. This is possible because the stud 53 has freed the passage.

The plate 41 continues its rotation as far as the rest position in FIG. 12. It is stopped in this position by the sensor 57.

Following these explanations, it will be appreciated that when the electric motor 33 is stopped, in particular because of an electrical fault, it is possible to act manually to close the door completely, at the second notch, starting from the positions in FIGS. 12 or 13.

Likewise, it is possible to act manually, without the aid of the motor 33, to open the door starting from the position in FIG. 16, since lifting the pawl 7, by manual action, frees the second notch 9 of the latch 5, and the nose 10 can pass the stud 53, in the direction of opening of the latch (rotation in the clockwise direction) without interfering with this stud 53 in the raised position.

By contrast, in the event of an electrical fault, when all the pieces are in the position in FIG. 14 or FIG. 15, with the nose 10 of the latch blocked by the stud 53, it would not be possible to open the door manually.

Figure 18:
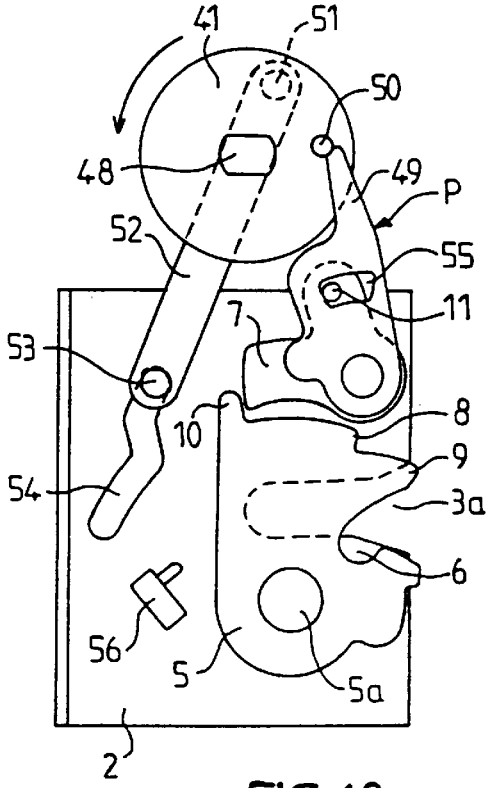
FIG. 18, finally, illustrates the end of opening.

If the electrical fault occurs in one of the positions in FIGS. 17 and 18, where the pawl 7 is held away from the notches 8 and 9 by the action of the stud 50, which pushes back the finger 49 and the piece P, it is not possible to close the door manually, that is to say to immobilize the latch 5 as illustrated in FIGS. 15 and 16, with the striker engaged in the fork 6.

The means of disengagement 42, described previously, have been provided for this purpose. By displacing the arm 47 in such a way as to allow the pusher 44 to slide towards the right in FIG. 11, the ball 43 is able to escape from the groove provided in the plate 41, which can then turn loosely on the shaft 40 and no longer exerts an immobilizing effect.

To prevent an accidental displacement of the lever 47, it is possible to lock this lever 47 in the coupled position in FIG. 11 with the aid of a second lever 59 (FIG. 10). This second lever 59 is arranged substantially at right angles to the first lever 47 and is mounted so as to pivot about a fixed pin 60 situated at the end remote from the lever 47. A window 61, substantially at right angles, is provided at that end of the lever 59 adjoining the lever 47, which includes a projecting stud 62 engaged in the window 61. The lower edge of the horizontal branch of the window 61 includes a concave part 63 which can serve as a seat for the stud 62 and can retain the latter.

In this configuration, the lever 47 is immobilized, and it is first necessary to displace the lever 59 to then allow the stud 62 to descend in the substantially vertical and downwardly directed part of the window 61. The lever 47 can then turn in the clockwise direction about its pivot 47*a* in order to free the pusher 44. The whole arrangement is intended to limit the travel of the pusher 44 and to prevent its complete escape.

A simple solution lies in a purely manual control, the lever 59 being subjected to the action of elastic return means in the clockwise direction about the pin 60, so that the stud 62 is maintained in the seat 63. To unlock the lever 47, the lever 59 has to be pushed in the anticlockwise direction counter to the elastic return means.

However, it is possible to provide automatic unlocking of the plate 41 on its passage through the angular positions corresponding on the one hand to those in FIGS. 14 and 15 and on the other hand to those in FIGS. 17 and 18.

For this, a disc 64 is fixed in rotation at hat end of the shaft 40 opposite the end equipped with the plate 41. This disc 64 includes, on its periphery, two indents 65, 66 which are positioned at suitable angles and whose rear edge in the sense of rotation (anticlockwise direction according to the representation in FIG. 10) is inclined in order to give the indent a widened shape as one moves away from the center.

The lever 59 includes a stud 67 projecting on the same side as the disc 64. This stud 67 bears against the periphery of the disc 64 under the action of a compression spring 68 which pushes the lever 59 in the anticlockwise direction. When the stud 67 is bearing against the circular periphery of the disc 64, the lever 59 is maintained in the position in FIG. 10, in which the stud 62 is immobilized in the seat 63. By contrast, when an indent 65 or 66 comes into line with the stud 67, the latter enters the indent under the action of the spring 68; the stud 62 can then descend in the window 61, under the action of a compression spring 69 acting on the lever 47 in order to turn it in the clockwise direction.

This therefore provides automatic unlocking of the plate 41 on each passage corresponding to the critical angular positions. The continuation of the rotation of the motor 33 and of the disc 64 provokes, via the action of the inclined edge of the indent, the escape of the stud 67 from this indent 65 or 66. The system returns to its locked position.

By preventing any accidental displacement of the lever 47, it is possible to ensure a correct functioning of the device which is subjected to shocks when the door, on being closed, is banged against the car bodywork.

What is claimed is:

1. An electric door lock comprising:

a latch moveable between an open and closed position and adapted to engage a striker;

a pawl which retains the latch in the closed position;

an intermediate lever having an end connected to the pawl;

internal and external opening rods which act on the pawl via the intermediate lever to release the latch to its open position;

the intermediate lever being pivotable about at least first and second axes of rotation forming an angle therebetween, whereby pivoting about the first axis disengages the intermediate lever from the external opening rod, pivoting about the second axis disengages the intermediate lever from the internal opening rod and pivoting the intermediate lever about both axes disengages both the internal and external opening rods; and an electric drive for pivoting the intermediate lever.

2. Lock according to claim 1, wherein the lever is pivotable by means of a ball-and-socket joint.

3. Lock according to claim 1, wherein the first and second axes about which the lever can pivot are orthogonal.

4. Lock according to claim 1, wherein the lever is pivoted to an intermediate piece which is connected to the pawl.

5. Lock according to claim 1, wherein the electric drive comprises electric motors, with reversible reducers, each assigned to control one of the two pivoting movements of the lever about the two different axes.

6. Lock according to claim 1 further comprising a piece pivotably mounted on a fixed pin which is parallel to the first axis and attached to a lock casing, the piece including a toothed sector able to mesh, in a reversible manner, with a helical pinon driven by the electric drive, and a fork having a seat;

a stud integral with the lever being able to leave the seat by a displacement which is substantially perpendicular to a mid plane of the fork, corresponding to pivoting the lever about the second axis.

7. Lock according to claim 6, wherein an end zone of the piece opposite the toothed sector is connected to a pull bar.

8. Lock according to claim 1 further comprising an arm whose overall direction is substantially orthogonal to a direction of the lever, this arm being carried by a helical pinion which is able to turn, in a reversible manner, about a geometric axis parallel to the second axis of pivoting of the lever, this arm being equipped, at its end remote from the pinion, with a fork which engages round a zone of the lever, rotational movement of the arm causing a pivoting movement of the lever about the second axis.

9. Lock according to claim 8, wherein the helical pinion is equipped at the end with an accessible mechanical socket to permit manual operation of the pinion if the electric drive breaks down.

10. Electric lock according to claim 1, in which the latch includes at least two angularly spaced notches for cooperating with the pawl, respectively in a first intermediate closed position and in a second complete closed position, and further comprising:

a second electric drive able to rotate a plate;

and a link rod pivoted at one of its ends on the plate and equipped, at its other end, with an activator able to bring the latch into the complete closed position in response to the rotation of the plate.

11. Electric lock according to claim 10, wherein the activator of the link rod comprises a stud on the link rod cooperating with a guide and able to act against a nose provided on the latch in order to push the latch into the complete closed position in response to the rotation of the plate.

12. Electric lock according to claim 10, further comprising a microcontact sensitive to the position of the latch in order to trigger the second electric drive when the latch arrives in the position where the first notch cooperates with the pawl, ensuring the passage of the latch from the intermediate closed position to the complete closed position in which the second notch cooperates with the pawl.

13. Lock according to claim 11, wherein the guide for the stud situated at the end of the link rod remote from the plate comprises a slot forming a cam provided on a main face of a backplate serving as a support for the latch and the pawl.

14. Lock according to claim 10, further comprising a piece which rotates about the same geometric axis as the pawl, the piece being linked in rotation to the pawl, with a free angular movement between the piece and the pawl over a limited angular range.

15. Lock according to claim 14, wherein a connection between the piece and the pawl comprises on the piece a window of a certain angular extent and on the pawl a projecting stud engaged in the window with a free movement between edges, of substantially radial orientation, of the window.

16. Lock according to claim 14 wherein the piece includes a projecting finger directed substantially towards the center of the plate, the finger being able to cooperate, depending on the angular position, with a stud provided near the periphery of the plate, the action of the stud against the finger making it possible to turn the piece in a direction which distances the pawl from the latch in order to permit opening.

17. Lock according to claim 10, wherein a stop position of the plate corresponding to the complete closed position, with cooperation of the second notch of the latch with the pawl, is controlled by a sensor in such a way that the stud situated at the end of the link rod remote from the plate occupies a position, which prevents any interference with the latch for a return to the open position.

18. Lock according to claim 10, further comprising means which make it possible to uncouple the plate from its drive pin so that the plate becomes loose in rotation and does not constitute an obstacle to manual opening or closing in the event of the second electric drive breaking down.

19. Lock according to claim 1 wherein an end of the intermediate lever remote from the pawl forms a blade in line with ends of the internal and external opening rods, the external and internal opening rods each being pivotable about fixed pins which are substantially parallel to the first and second axes, respectively, and wherein pivoting the lever about the first axes disengages the blade from the external opening rod while remaining in cooperation the internal connecting rod, pivoting the lever about the second axis disengages the blade from the internal connecting rod while remaining in cooperation with the external opening connecting rod, and combined pivoting about both the first and second axes disengages the blade from both the internal and external opening rods.

20. Lock according to claim 14 wherein the piece includes a projecting lug, the piece being pivotably arranged on the intermediate lever by a ball and socket joint provided on the lug between the pawl and the internal and external opening rods.

* * * * *